US010897661B2

(12) United States Patent
Ecosse

(10) Patent No.: US 10,897,661 B2
(45) Date of Patent: Jan. 19, 2021

(54) LOUDSPEAKER CABINET FRAME COMPRISING A CONNECTION DEVICE FOR CONNECTING TO ANOTHER LOUDSPEAKER CABINET AND A LOUDSPEAKER CABINET COMPRISING SUCH A FRAME

(71) Applicant: NEXO, Plailly (FR)

(72) Inventor: Eric Ecosse, Vitry-sur-Seine (FR)

(73) Assignee: NEXO, Plailly (FR)

( * ) Notice: Subject to any disclaimer, the term of this patent is extended or adjusted under 35 U.S.C. 154(b) by 0 days.

(21) Appl. No.: 16/727,103

(22) Filed: Dec. 26, 2019

(65) Prior Publication Data

US 2020/0213698 A1 Jul. 2, 2020

(30) Foreign Application Priority Data

Dec. 27, 2018 (FR) ..... 18 74253

(51) Int. Cl.
*H04R 1/02* (2006.01)

(52) U.S. Cl.
CPC ..... *H04R 1/026* (2013.01); *H04R 1/025* (2013.01); *H04R 2201/025* (2013.01)

(58) Field of Classification Search
CPC ... H04R 1/026; H04R 1/025; H04R 2201/025
USPC ..... 381/395
See application file for complete search history.

(56) References Cited

U.S. PATENT DOCUMENTS 8,130,996 B2 3/2012 Kling et al.
9,516,396 B2 * 12/2016 Andrews ..... H04R 1/025
9,716,929 B1 * 7/2017 Lippitt ..... H04R 1/026
2012/0093347 A1 * 4/2012 Adamson ..... H04R 1/026 381/300
2014/0307907 A1 * 10/2014 Takeuchi ..... H04R 1/025 381/334
2018/0058629 A1 * 3/2018 Hart ..... E04B 9/006
2018/0063611 A1 * 3/2018 Hart ..... H04R 1/025

FOREIGN PATENT DOCUMENTS

EP 1523214 A2 4/2005
EP 1523214 A3 1/2007
EP 2640087 A1 9/2013

OTHER PUBLICATIONS

French Search Report, dated Oct. 9, 2019, from corresponding French application No. 1874253.

* cited by examiner

*Primary Examiner* — Sean H Nguyen
(74) *Attorney, Agent, or Firm* — Nixon & Vanderhye

(57) ABSTRACT

A frame for a loudspeaker cabinet including a connection device for connecting to another loudspeaker cabinet, the connection device including a eyelet and a locking system, the locking system including a front leg and a back leg, a slide disposed between the two legs and configured to slide between a high position and a low position under the action of a first elastic member connected to the slide, and an actuator configured to take a pulled position and a pushed position. The locking system being configured to take a locked configuration and a cocked configuration, the locking system passing from the locked configuration to the cocked configuration by movement of the actuator and from the cocked configuration to the locked configuration by movement of the slide from the low position to the high position.

20 Claims, 11 Drawing Sheets

LOUDSPEAKER CABINET FRAME COMPRISING A CONNECTION DEVICE FOR CONNECTING TO ANOTHER LOUDSPEAKER CABINET AND A LOUDSPEAKER CABINET COMPRISING SUCH A FRAME

BACKGROUND OF THE INVENTION

Field of the Invention

The present invention concerns the field of loudspeaker cabinets.

It more particularly concerns a loudspeaker cabinet frame comprising a connection device for connecting to another loudspeaker cabinet.

It also concerns a loudspeaker cabinet comprising such a frame.

Lastly, it concerns two loudspeaker cabinets each comprising such a frame and which are coupled with each other by means of their frame.

Description of the Related Art

In large halls such as theatre, concert or conference halls, loudspeaker cabinets are generally disposed in a particular manner in order to obtain a specific acoustic result. One acoustic objective which is highly sought-after is in particular to optimize the ratio between the volume of sound and the desired zone of coverage.

To that end, loudspeaker cabinets are sometimes assembled together, in particular in a column (or "line arrays"), by virtue of connection devices present on each cabinet. These assemblies may consist of several cabinets, which may each weigh more than 50 kilograms. The cabinets are next either placed in a disposition suspended in the air by virtue of coupling means or are placed on the ground.

Most of the cabinets configured to be assembled together comprise a frame enabling the different parts of the cabinet to be supported and held. The frame of each cabinet generally comprises a connection device making it possible to couple it to another cabinet.

In this connection, document EP 2 640 087 for example is known which discloses a loudspeaker cabinet comprising a connection device for connecting to another loudspeaker cabinet.

The connection device comprises a locking system and an eyelet. The locking system described in this document is a T-shaped assembly housed under the cabinet and which comprises a mechanism making it possible to drive the movement of a latch. On assembly and disassembly between a first cabinet and a second cabinet, the locking system is configured to adopt a locked configuration in which a latch of the first cabinet is accommodated in an eyelet of the second cabinet and an unlocked or cocked configuration in which the latch of the first cabinet is withdrawn from the eyelet of the second cabinet.

In this context of loudspeaker cabinet assembly, other mechanisms may be used in the locking systems. In particular, a locking system comprising a slide may be envisioned. However, it is then necessary to pay attention to the stability and smoothness of the locking system, and to avoid the slide derailing from its sliding zone, which could lead to jamming of the locking system, during locking or cocking.

SUMMARY OF THE INVENTION

The present invention is directed to solving at least one of the aforementioned drawbacks, possibly also leading to other advantages.

Thus, the invention concerns a frame for a loudspeaker cabinet comprising a connection device for connecting to another loudspeaker cabinet, the connection device comprising an eyelet and a locking system, the locking system comprising:

two legs, which are a front leg and a back leg, disposed parallel to each other and each comprising a lower aperture and an upper aperture;

a slide disposed between the two legs and configured to slide between a high position and a low position, the slide comprising an opening having at least one wide portion and at least one narrow portion, and being provided with two guide members, each bearing on an edge of at least one of the two legs on opposite sides of the leg;

at least one spacer linking the two legs to each other;

a first elastic member connected to said slide and configured to bring the slide automatically from the high position to the low position;

a selecting screw comprising a shaft having at least one wide section and at least one narrow section, the shaft of the selecting screw passing through the upper aperture of each of the legs and the opening of the slide, and being configured to move between a returned position in which the at least one wide section of the shaft is inside the opening of the slide and a moved away position in which the at least one narrow section of the shaft of the screw is inside the opening of the slide;

a second elastic member connected to the selecting screw and configured to return the selecting screw automatically from the moved away position to the returned position;

a locking member comprising a locking shaft configured to take a locking position in which the locking shaft passes through the lower aperture of each of the two legs and an opening position in which the locking shaft frees at least partly a space defined between the two legs;

an actuator configured to take a pulled position and a pushed position and joined to the selecting screw and to the locking shaft, the locking system being configured to take a locked configuration wherein:

the slide is in high position;

the selecting screw is in returned position in which the wide section of the shaft is inside the wide portion of the opening of the slide; and the locking shaft is in locking position;

and a cocked configuration in which:

the slide is in low position;

the selecting screw is in moved away position in which the narrow section of the shaft is inside the opening of the slide; and the locking shaft is in opening position;

the locking system passing from the locked configuration to the cocked configuration by movement of the actuator and from the cocked configuration to the locked configuration by movement of the slide from the low position to the high position.

The loudspeaker cabinet frame so configured and comprising such a connection device enables an automatic assembly of the cabinets having the advantage of being simple and more reliable. The locking and the cocking of the locking system may be carried out by a single operator. By approaching one cabinet with a locking system in cocked configuration to another cabinet, the two cabinets automatically lock themselves together.

The guide members of the slide, by sliding against the edges of the legs, enable proper guiding of the slide between the legs. The translation movement of the slide is thus smooth. Furthermore, the fluidity of the sliding of the slide is improved by the presence of the spacer linking the legs and enabling the legs to be held parallel to each other, with better consistency in their spacing with respect to each other.

The assembly and the cocking of the cabinets is facilitated since at least some of the movements of the various members composing the connection device is made automatic. In particular, the use of the first elastic member connected to the slide enables the translation movement of the slide from the high position to the low position to be made automatic. Moreover, the use of the second elastic member connected to the selecting screw enables the movement of the selecting screw from the moved away position to the returned position to be made automatic.

The locking shaft ensures the proper locking of the locking system and thereby a secure assembly of the two cabinets.

Lastly, the use of the actuator facilitates the use of the locking system by an operator.

According to a feature, the locking member comprises a collar joined to the locking shaft, the collar being formed around the locking shaft and having an outside diameter greater than a diameter of the lower aperture of the front leg.

The collar also constitutes a means for providing security. As the collar has an outside diameter greater than a diameter of the lower aperture of the front leg, the collar prevents the locking shaft from possibly passing beyond the legs.

According to another feature, the locking system comprises a connecting leg fastened both to the locking member and to the selecting screw, and the locking member is crimped onto the connecting leg.

The crimping of the locking member on the connecting leg constitutes an additional means for providing security for the assembly between the locking member and the legs. Furthermore, this makes it possible to better ensure squaring up between the locking member and the connecting leg.

According to a feature, the actuator comprises a part that is molded over at least part of the locking member.

Such molding over promotes the joining of the actuator to the locking member.

According to another feature, the locking system comprises two spacers connecting the two legs to each other, the two spacers being disposed on opposite sides of the legs.

The use of two spacers on respective opposite sides of the legs enables the smoothness of the sliding of the slide to be further improved on account of the legs being held parallel.

According to a feature, the legs each comprise two upper apertures, the locking system comprising two selecting screws, the shafts of the two selecting screws passing through the upper apertures of the two legs. The opening of the slide comprises at least two wide portions and at least two narrow portions. The wide sections of the two selecting screws are inside the opening of the slide in returned position and the narrow sections of the two selecting screws are inside the opening in moved away position.

According to another feature, the slide is provided with two pairs of guide members, each pair of guide members bearing on an edge of at least one of the two legs, on opposite sides of the leg.

The use of four guide members enables the guiding of the slide to be still further improved and thus enables the smoothness of the sliding to be improved.

According to a feature, the locking system is configured to take a forced open configuration wherein:

the slide is in an upper position;

the selecting screw is in moved away position in which the narrow section of the shaft is inside the opening of the slide; and the locking shaft is in opening position;

the locking system passing to the forced open configuration by movement of the slide to the upper position.

In particular, the locking system passes from the cocked configuration to the forced open configuration by movement of the slide from the low position to the upper position. Moreover the locking system passes from the locked configuration to the forced open configuration by movement of the actuator from the pushed position to the pulled position and of the slide from the high position to the upper position.

The forced open configuration may be used on disconnecting two cabinets which were initially assembled together. The placing in forced open configuration thus makes it possible to avoid the cabinets remaining coupled together after unlocking or disconnection.

According to a feature, the slide may take the high position, the upper position and the low position. The high position is a position located between the upper position and the low position.

According to a feature, the frame comprises two connection devices configured to be disposed on respective opposite sides of the cabinet.

The invention also concerns a loudspeaker cabinet comprising a frame having at least some of the aforementioned features.

Lastly, the invention also concerns a set of at least two loudspeaker cabinets comprising a first loudspeaker cabinet and a second loudspeaker cabinet each comprising a frame having at least some of the preceding features. The eyelet of the second cabinet is locked in the locking system of the first cabinet when the first and second cabinets are assembled to each other.

BRIEF DESCRIPTION OF THE DRAWINGS

Still other particularities and advantages of the invention will appear in the following description with reference to the accompanying drawings which are given by way of non-limiting examples.

DESCRIPTION OF THE PREFERRED EMBODIMENTS

Figure 1:
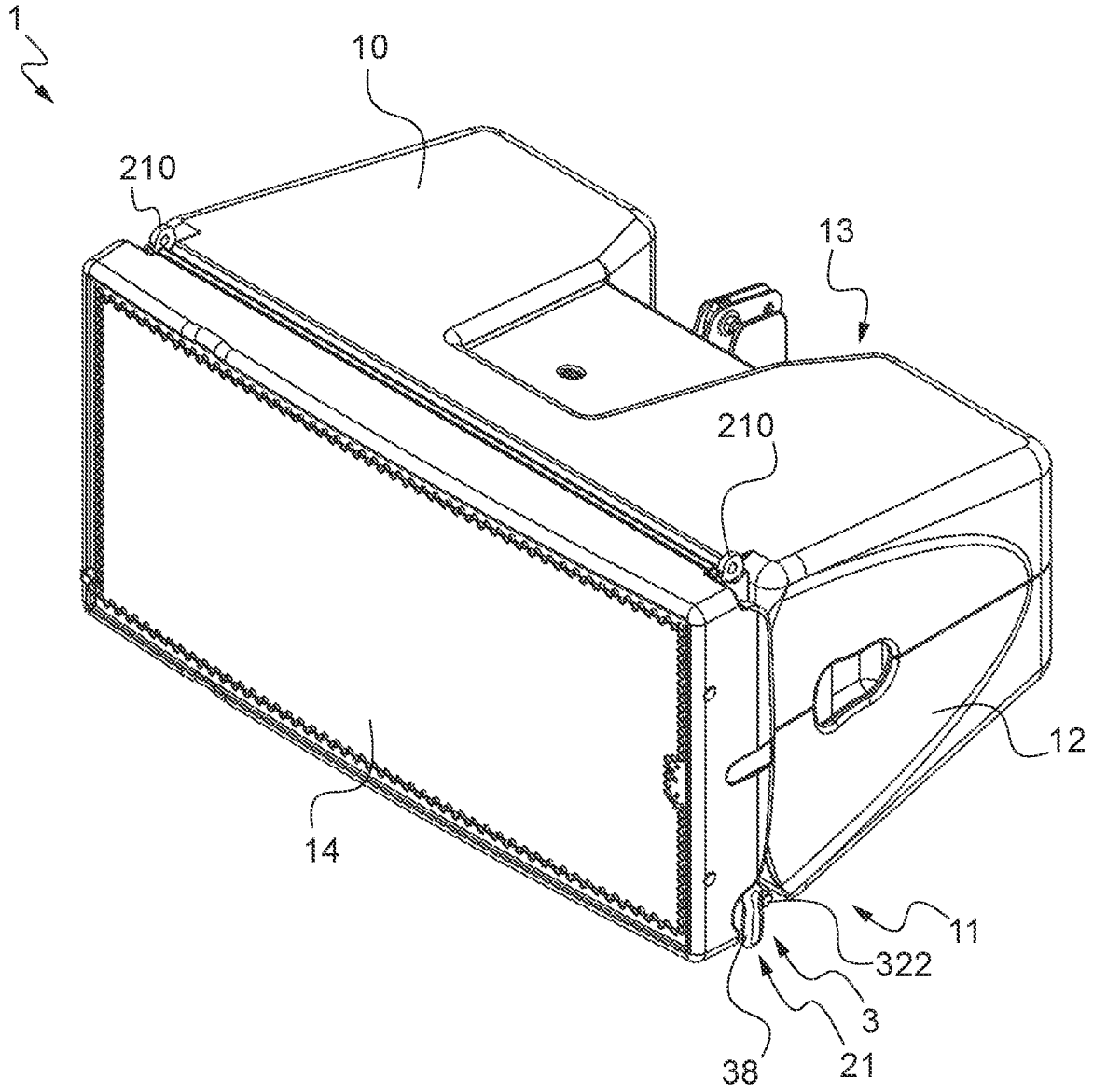
FIG. 1 is a perspective view of a loudspeaker cabinet having a frame comprising a connection device according to an embodiment in accordance with the invention.

FIG. 1 presents a loudspeaker cabinet 1 of substantially parallelepiped shape. The cabinet 1 comprises outside walls, in particular an upper wall 10, a lower wall 11, two lateral walls 12, a back wall 13 and a front wall. The front wall is not visible in the drawings and is covered by a grid 14 enabling the emission of acoustic waves.

In this document, the terms high, low, above, below, upper and lower are used to facilitate understanding and should be understood as being relative to the figures and to the illustrated embodiment. These terms must not therefore give rise to a restrictive interpretation.

Figure 2:
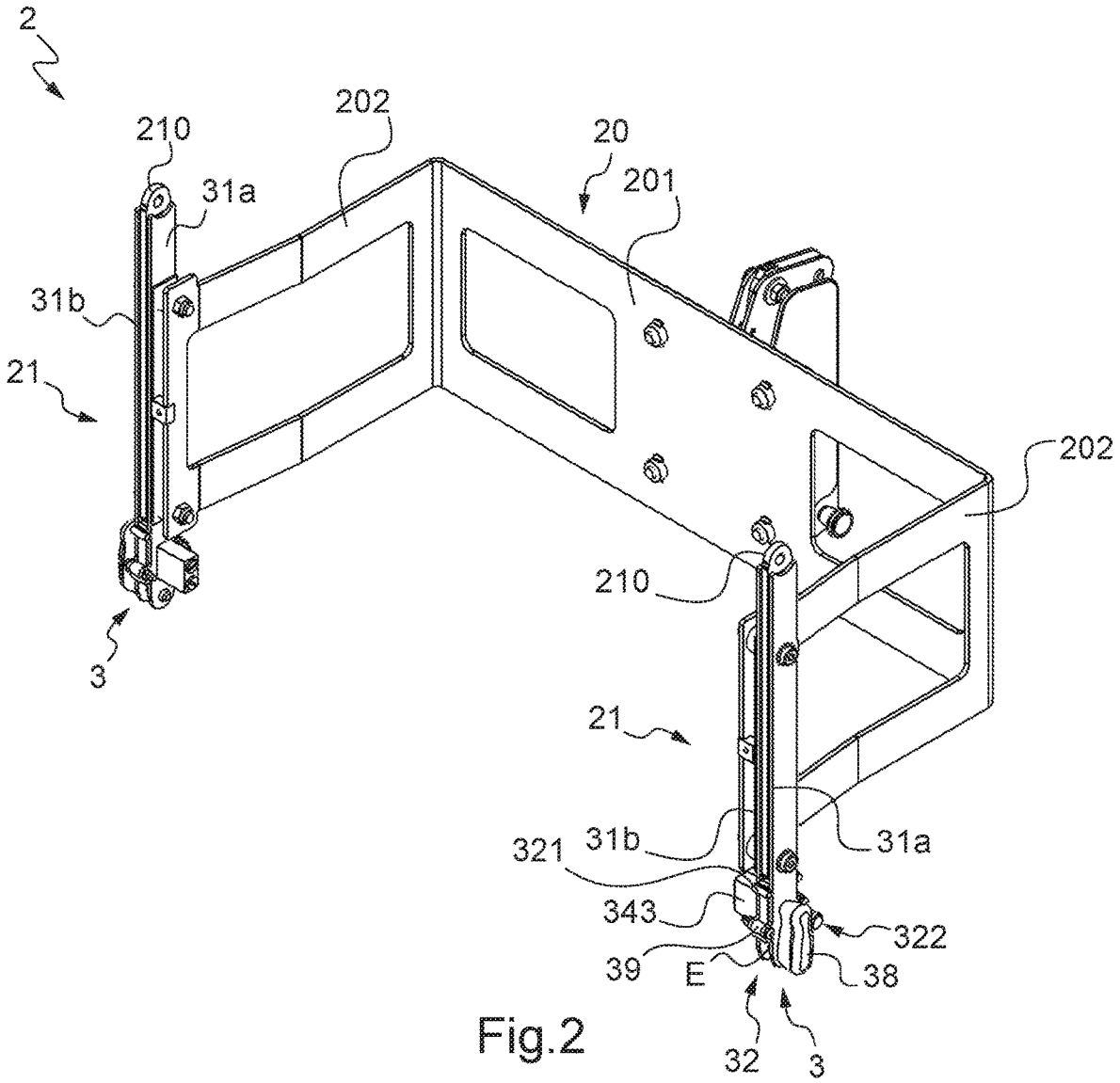
FIG. 2 is a perspective view of the frame of the loudspeaker cabinet of FIG. 1.

The cabinet 1 comprises a frame 2 which can be seen in part in FIG. 1 and is represented alone in FIG. 2. According to the illustrated embodiment, the frame 2 comprises a support part 20 having a U-shape. The support part 20 comprises a central part 201 and two turned-back wings 202 extending from the central part 201. The support part 20 in this example surrounds three quarters of the cabinet 1.

According to the illustrated example embodiment, the frame 2 comprises two connection devices 21 fastened to the support part 20 and enabling the connection to another loudspeaker cabinet. The two connection devices 21 are fastened here to the turned-back wings 202 symmetrically relative to a median plane of the frame 2.

Of course, the number and the disposition of the connection devices can vary. In all that follows in the document, the description will be made relative to a single connection device but of course remains valid for the other connection device.

The connection device 21 comprises an eyelet 210 and a locking system 3.

The locking system 3 comprises two legs, which are a front leg 31*a* and a back leg 31*b*. The legs 31*a*, 31*b* are disposed here facing each other and parallel to each other. Each leg 31*a*, 31*b* here takes the form of a plate with substantially rectangular contours and comprises two planar faces 314 referred to as inner planar face and outer planar face. An inner planar face of the front leg 31*a* is disposed facing an inner planar face of the back leg 31*b*.

Each leg 31*a*, 31*b* comprises a lower aperture 311 and two upper apertures 312.

Figure 3A:
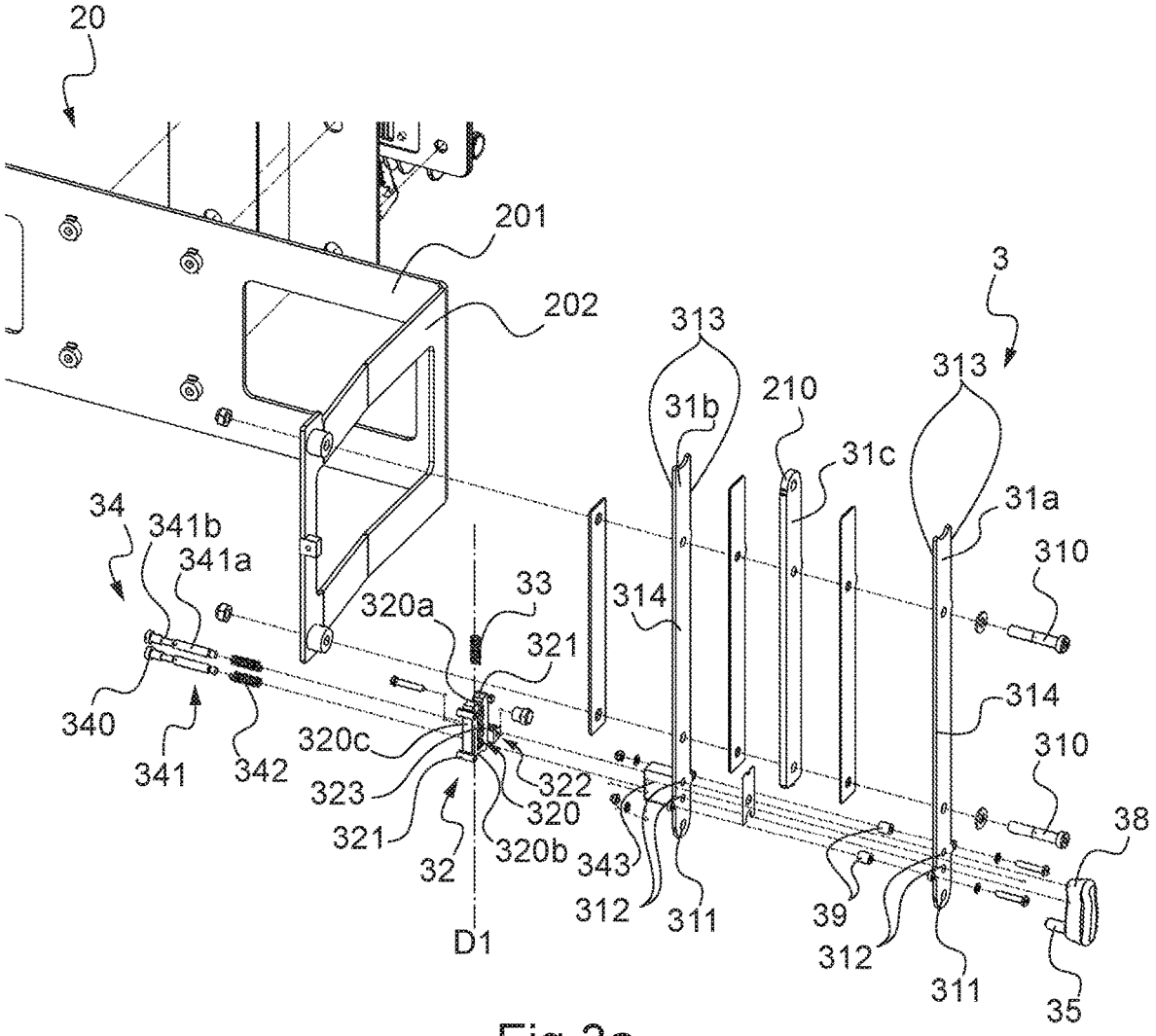
FIG. 3*a* is an exploded perspective view of the connection device according to the embodiment of FIGS. 1 and 2.

As can be seen in FIG. 3*a* presenting an exploded view of one of the two connection devices 21 fastened to one of the two wings 202, the frame 2 here also comprises an intermediate leg 31*c* disposed between the legs 31*a*, 31*b*.

The intermediate leg 31*c* is substantially parallel to the legs 31*a*, 31*b*.

The legs 31*a*, 31*b* extend beyond a lower end of the intermediate leg 31*c* so as to define a space E between the two legs 31*a*, 31*b* below the intermediate leg 31*c*. The lower aperture 311 and upper aperture 312 are formed here in the portions of the legs 31*a*, 31*b* defining between them the space E.

In this example, the intermediate leg 31*c* comprises the eyelet 210. The legs 31*a*, 31*b* and the intermediate leg 31*c* are disposed such that only the eyelet 210 extends beyond the upper ends of the legs 31*a*, 31*b*.

Two fastening screws 310 enable the fastening of the legs 31*a*, 31*b* and of the intermediate leg 31*c* to one of the turned-back wings 202 of the support part 20.

Figure 3B:
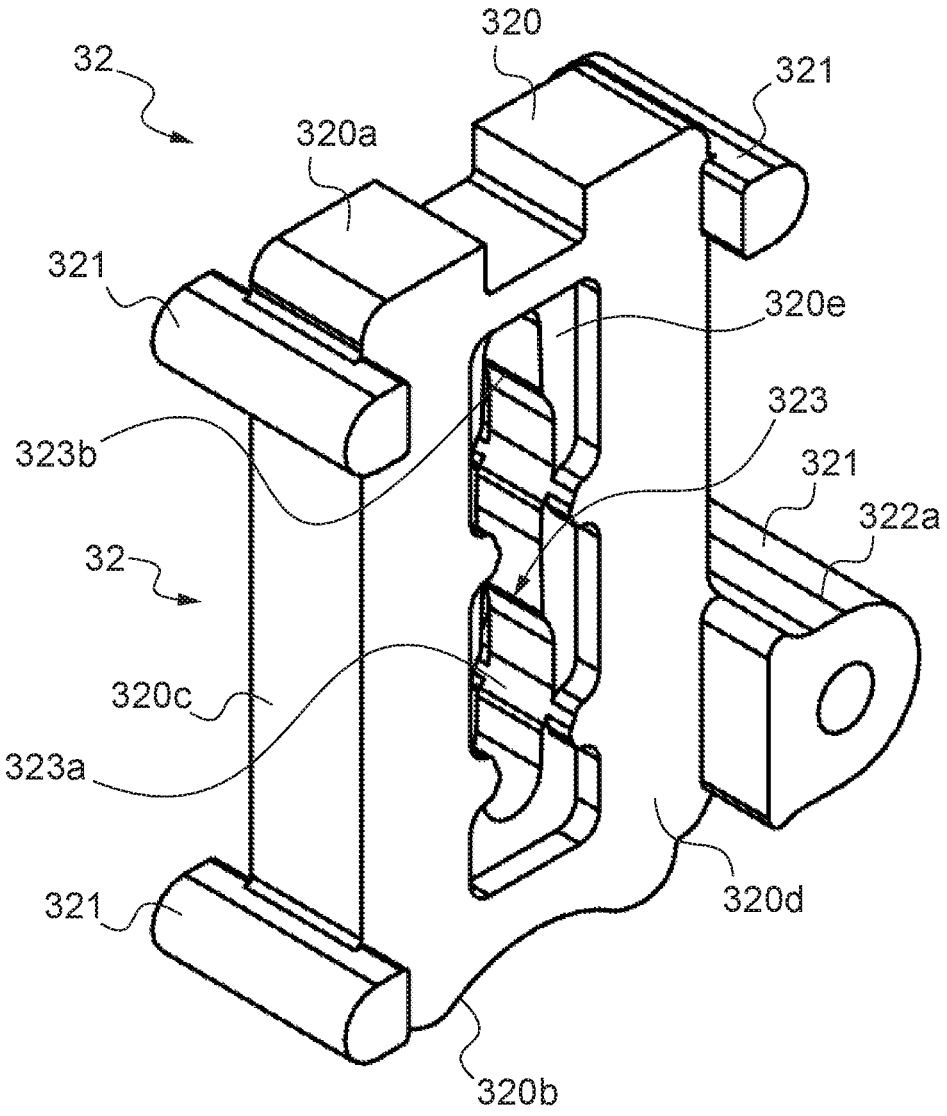
FIGS. 3*b*, 3*c* and 3*d* respectively represent a perspective view, a front view of a slide of the connection device, and a perspective view of the slide furthermore equipped with a grip member.
Figure 3C:
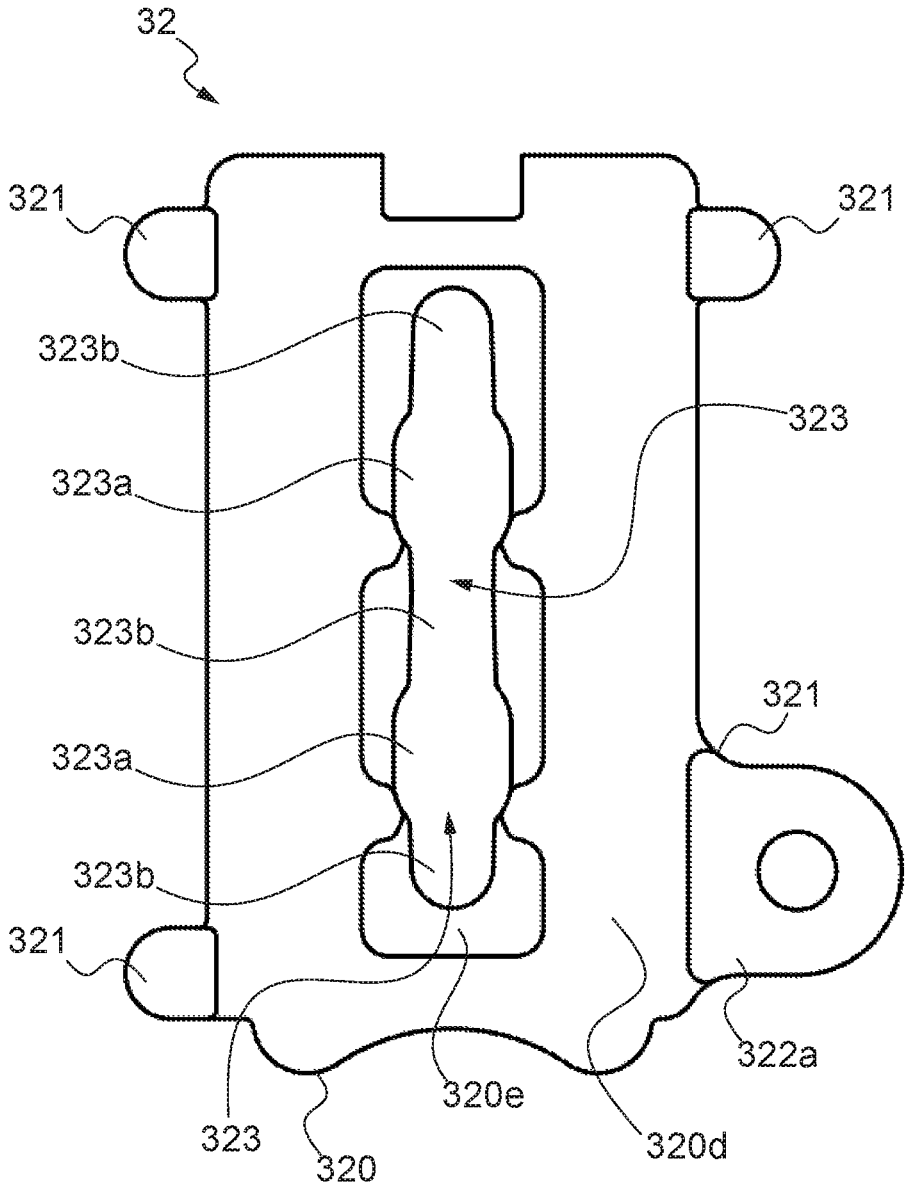
Figure 3D:
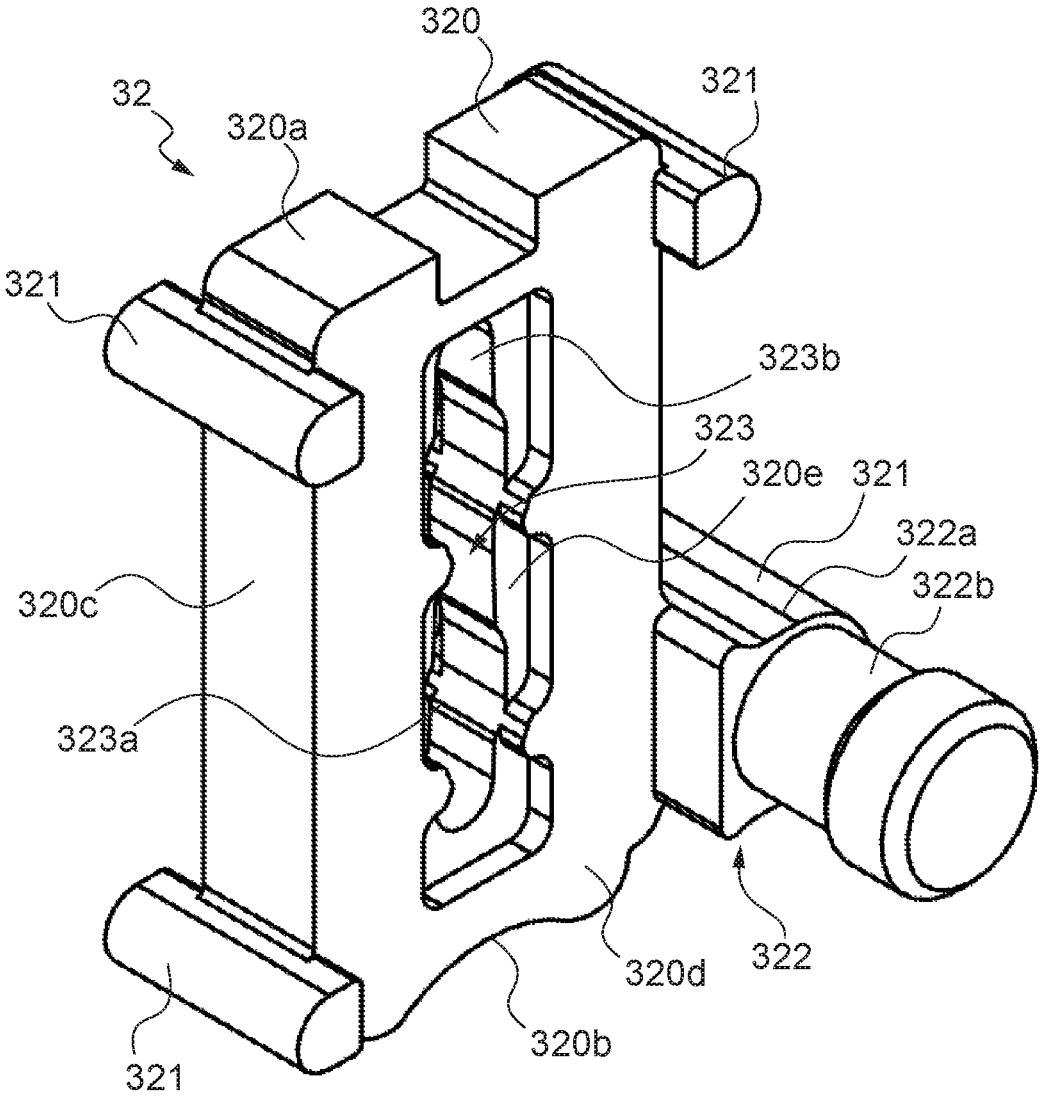

The locking system 3 also comprises a slide 32, represented in more detail in FIGS. 3*b* to 3*d*. The slide 32 here comprises a slide part 320, and is provided with guide members 321 and a grip member 322.

The slide part 320 is disposed between the two legs 31*a*, 31*b*, in particular in the space E, as can be seen in FIGS. 4*a*, 4*b*, 5*a*, 5*b*. The slide part 320 present here has a substantially parallelepiped shape and comprises an upper face 320*a*, a lower face 320*b*, lateral faces 320*c* and front and back faces 320*d* disposed facing the legs 31*a*, 31*b*.

As FIGS. 3*b* to 3*d* illustrate in more detail, the slide 32 comprises an opening 323, here formed in the slide part 320. The opening 323 is next disposed opposite the upper apertures 312 of the legs 31*a*, 31*b*. The opening 323 has a variable width. The opening 323 comprises at least one wide portion 323*a* and at least one narrow portion 323*b*. The narrow portion 323*b* has a smaller width than the wide portion 323*a*. The opening 323 in this example comprises two wide portions 323*a* and three narrow portions 323*b*. Here, each of the wide portions 323*a* of the opening 323 is disposed between two narrow portions 323*b* and the narrow portion 323*b* of the middle is between the two wide portions 323*a*, i.e.: a narrow portion 323*b*, a wide portion 323*a*, a narrow portion 323*b*, a wide portion 323*a* then a narrow portion 323*b*. In other words, the wide portions 323*a* are interposed between the narrow portions 323*b*.

Furthermore, at least some of the parts of the opening 323 are here surrounded by a rim 320*e* which is set back relative to at least the front face 320*d* of the slide part 320 of the slide 32.

In particular here, a first rim 320*e* here surrounds a narrow portion 323*b* and at least part of the juxtaposed wide portion 323*a*, then a second rim 320*e* is formed on opposite sides of the narrow central portion 323*b* and of at least part of the following wide portion 323*a*, then a third rim 320*e* surrounds the narrow third portion 323*b*.

Of course, the shape and dimensions of the opening of the slide can vary. In particular, the number of wide and narrow portions can vary.

In the illustrated embodiment, the guide members 321 are formed projecting relative to the lateral faces 320*c* of the slide part 320. The guide members 321 are four in number here, two guide members 321 projecting from each lateral face 320*c* of the slide part 320. The guide members 321 are symmetrically formed such that the guide members 321 are formed projecting from the four corners of the slide part 320.

The guide members 321 are disposed outside the space E formed between the legs 31*a*, 31*b*. Each guide member 321 bears on the edges 313 of the two legs 31*a*, 31*b* on opposite sides of the legs. The edges 313 of the legs 31*a*, 31*b* and lateral faces 320*c* of the slide part 320 are coplanar here.

The guide members 321 here are of cylindrical shape. The guide members 321 protrude relative to the outer planar faces of the front leg 31*a* and the rear leg 31*b*.

The guide members 321 enable the guiding of the slide 32 in its translation movement between the two legs 31*a*, 31*b*.

The cylindrical shape of the guide members 32 and their dimensions enable bearing on several points against the edges 313 of two legs 31*a*, 31*b*. The bearing at several points enables the guiding of the slide to be improved, as well as the stability of the slide and the smoothness of the sliding movement.

According to an example embodiment not shown, the guide members 321 are able to bear only against the edges 313 of only one of the two legs 31*a*, 31*b*. The guide members 321 may also have a different shape and/or dimensions. For example, the guide members 321 may have a semi-cylindrical shape. The number of bearing points, or the size of the bearing surface, vary according to the shape and dimensions of the guide members. Furthermore, the number of guide members 321 can vary. By way of example, the slide can comprise only two guide members, preferably on opposite sides of at least one of the legs. Lastly, the guide members 321 may be distributed in a different disposition. Three guide members 321 may be formed on a lateral face 320*c* and one guide member 321 on the other lateral face 320*c* of the slide part 320.

In the present example embodiment, one of the guide members 321 comprises a hole in which is inserted the grip member 322.

The grip member 322 comprises a cylindrical part 322*a* and a handle 322*b*, joined to the cylindrical part 322*a*. The grip member 322 enables the slide 32 to be guided manually. More particularly, by gripping the handle 322*b*, an operator can slide the slide 32 between the two legs 31*a*, 31*b*.

The locking system 3 further comprises a first elastic member 33 connected to the slide 32 and also connected to the intermediate leg 31*c*. The first elastic member 33 is connected here to the slide part 320 at the upper face 320*a*.

In particular here, the first elastic member 33 works in compression and is configured to push the slide 32 away relative to the intermediate leg 31*c*.

The locking system 3 comprises two spacers 39 (which can be seen in FIGS. 2 and 3*a*) connecting the legs 31*a*, 31*b*. The two spacers 39 are disposed on opposite sides of the legs 31*a*, 31*b*. The spacers 39 make it possible to keep the spacing between the legs 31*a*, 31 *b* constant. The legs 31*a*, 31*b* are thus held parallel to each other, which improves the smoothness of the translation movement of the slide 32.

Of course, the number of spacers 39 can vary. A single spacer may for example suffice to connect the two legs 31*a*, 31*b*.

The locking system 3 further comprises two selecting screws 34 which can be seen in particular in FIG. 3*a*. The selecting screws 34 are inserted in the upper apertures 312 of the legs and pass through the opening 323 of the slide 32.

Each selecting screw 34 comprises a head 340 and a shaft 341. The shaft 341 of each selecting screw 34 comprises a wide part 341*a* having a section referred to as wide and a narrow part 341*b* having a section referred to as narrow, of diameter less than that of the wide section. The wide section 341*a* is dimensioned so as to substantially match the wide portions 323*a* of the opening 323: it for example has a greater diameter than the width of the narrow portions 323*b* and at most equal to the width of the wide portions 323*a*. The narrow part 341*b* is dimensioned so as to match at most the width of the narrow portions 323*b* of the opening 323. The head 340 of each selecting screw 34 has at least one section having a wider diameter than the opening and in particular of the wide portions 323*a*. The head 340 of each selecting screw 34 thus makes it possible to avoid the selecting screw 34 separating from the slide 32 and in particular avoid the selecting screw 34 coming completely out of the opening 323.

The locking system 3 also comprises a guide block 343. The guide block 343 surrounds part of the selecting screws 34, here the head 340 and part of the shaft 341 of each selecting screw 34. The guide block 343 here has a parallelepiped shape and bears against the back leg 31*b*. The guide block 343 enables the translation movement of the selecting screw 34 to be guided.

The locking system 3 further comprises a second elastic member 342, shown diagrammatically in FIG. 3*a*.

The second elastic member 342 is disposed here in the guide block 343 and connected to each selecting screw 34.

In particular, the second elastic member 342 surrounds part of the shaft of the selecting screw 34 and is held in compression between the head of the selecting screw 34 and a bottom of the guide block 343, which is juxtaposed against the back leg 31*b*.

The second elastic member 342 is thus configured to push away the corresponding screw head and thus drive the actuator 38 into pushed position, as explained below.

Figure 4A:
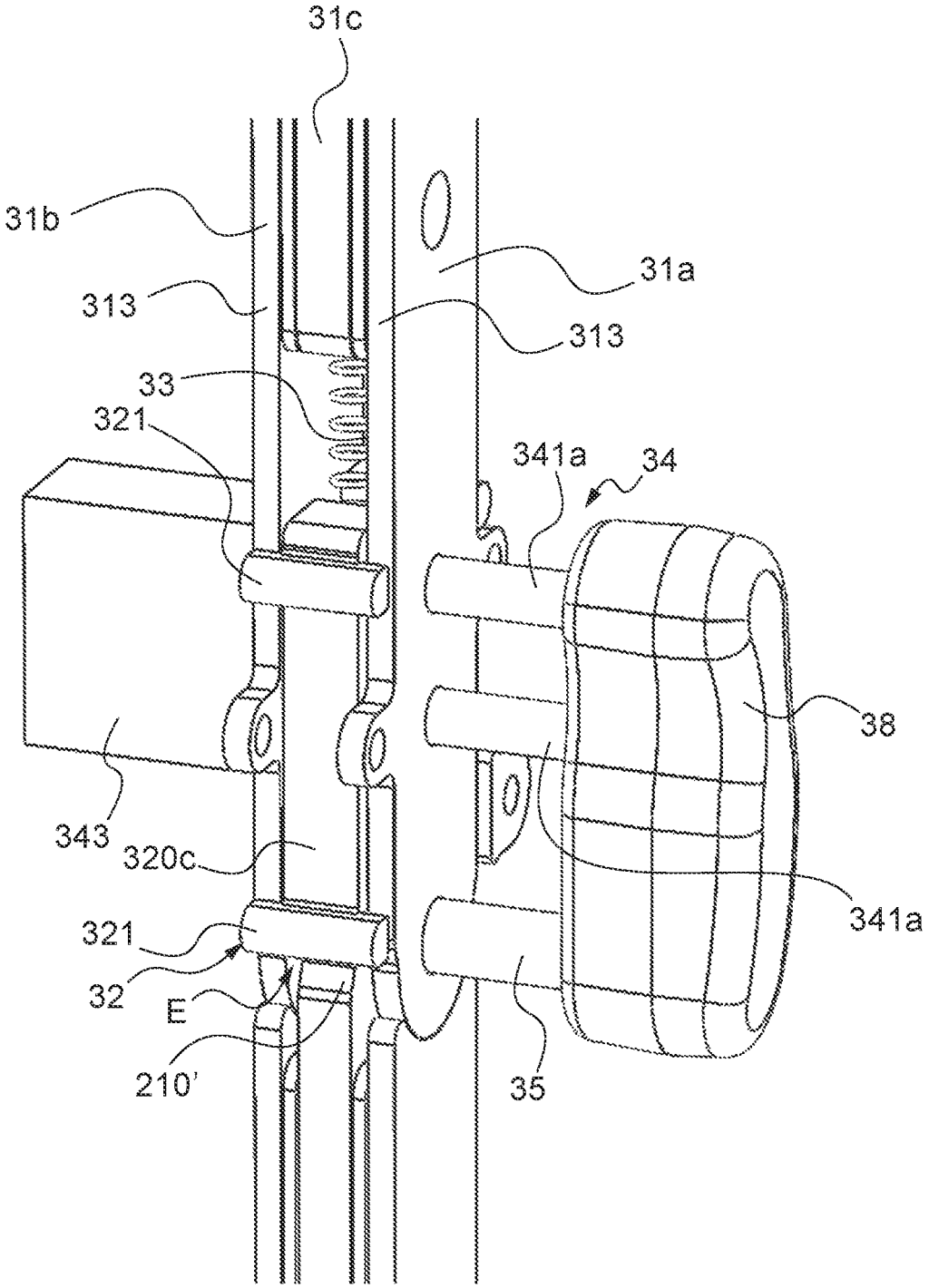
FIGS. 4*a* and 4*b* represent, respectively in solid line and with transparency, a locking system of the connection device from which an eyelet of a second cabinet has been freed.
Figure 4B:
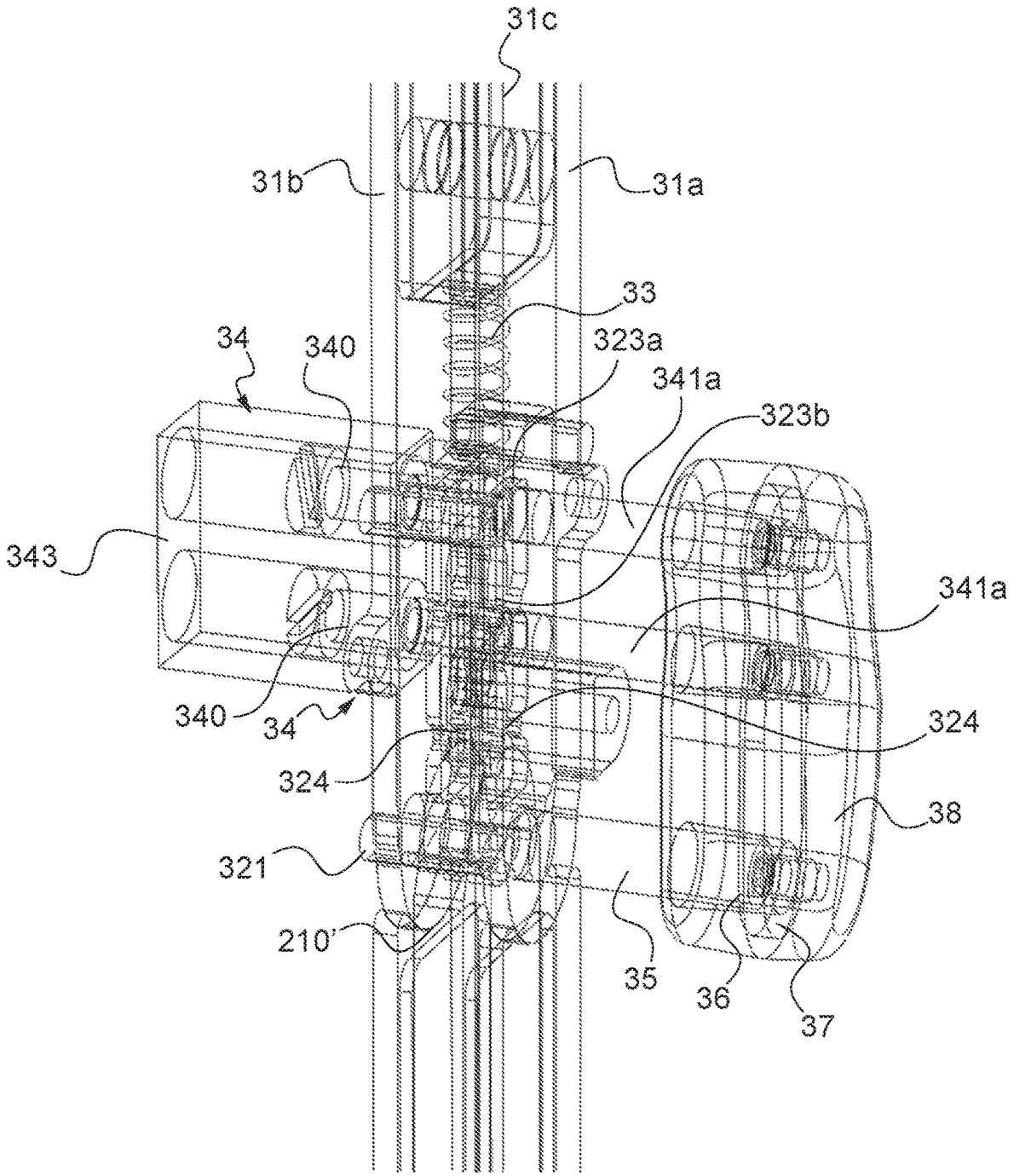

In the described embodiment, the locking system 3 also comprises a locking member, shown diagrammatically in FIG. 4*b* for example. The locking member comprises a locking shaft 35 and a collar 37 joined together.

The locking shaft 35 is disposed here below the slide 32. The locking shaft 35 is inserted at least into the lower aperture 311 of the front leg 31*a*.

The collar 37 is formed around the locking shaft 35. The collar 37 is formed outside the space formed between the two legs 31*a*, 31*b*, facing the front leg 31*a*. The collar 37 has an outer diameter greater than the diameter of the lower aperture 311 of the front leg 31*a*.

The locking system 3 here comprises a connecting leg 36 disposed facing the front leg 31*a*. The connecting leg 36 and the front leg 31*a* are disposed parallel to each other here. The connecting leg 36 here comprises three through holes (indicated in FIG. 5*b*); two upper through holes 360 formed facing the upper apertures 312 of the legs 31*a*, 31*b* and a through hole 361 formed facing the lower aperture 311 of the legs 31*a*, 31*b*. The locking shaft 35 and the two selecting screws 34 are respectively inserted into the upper 360 and lower 361 through holes. The angle formed by the locking shaft 35 and the connecting leg 36 is a right angle here.

The locking member is crimped onto the connecting leg 36. In case the locking shaft 35 and the connecting leg 36 are separated, the collar 37 prevents the locking shaft 35 from sliding beyond the legs 31*a*, 31*b*. The collar 37 thus constitutes a means for providing security for the locking of the locking system 3.

In the illustrated example embodiment, an actuator 38 is connected to the selecting screws 34 and to the locking shaft 35. The actuator 38 here has the form of a handle and bears against the front leg 31*a*. The actuator 38 enables the gripping, for example by an operator, of the selecting screws 34 and of the locking shaft 35.

The actuator 38 is formed here by molding over at least the locking shaft 35 and the connecting leg 36. Preferably, the molding over is carried out later than the assembly of the connecting leg 36 to the locking shaft 35. This makes it possible to ensure squaring up between the locking shaft 35 and the locking leg 36.

Each locking system 3 can take a locked configuration, a cocked configuration and a forced open configuration. The cabinet 1 is assembled to another cabinet when the two locking systems 3 are in the locked configuration, that is to say with the eyelet of one locked into the locking system of the other. When the two locking systems 3 are in cocked position, the two cabinets are not assembled. The various configurations are detailed later in the present document.

In the described embodiment, the slide 32 is able to slide vertically between the two legs 31*a*, 31*b*. The slide 32 is able to take a high position when the locking system 3 is in the locked configuration, an upper position when the locking system is in the forced open configuration and a low position when the locking system 3 is in the cocked configuration.

In the high and upper positions, the first elastic member 33 is compressed. In the low position, the first elastic member 33 is relaxed. The first elastic member 33 is configured to return the slide automatically from the high position 32 to the low position;

Each selecting screw 34 is able to move between a returned position, and a moved away position. The selecting screw 34 is in the returned position when the locking system 3 is in locked configuration. The selecting screw 34 is in the moved away position when the locking system 3 is in cocked configuration or in forced open configuration. In returned position, the wide section of the shaft 341 of the selecting screw 34 is in the opening 323 of the slide 32. In moved away position, the narrow section of the shaft 341 of the screw 34 is in the opening 323 of the slide 32. The second elastic member 342 is configured to return the corresponding selecting screw 34 automatically from the moved away position to the returned position.

The locking shaft 35 moves so as to take two positions; a locking position and an opening position. The locking shaft 35 is in locking position when the locking system 3 is in locked configuration. The locking shaft 35 is in moved away position when the locking system 3 is in cocked configuration or in forced open configuration. In locking position, the locking shaft 35 passes through the lower aperture 311 of each of the two legs 31*a*, 31*b*. In opening position, the locking shaft 35 at least partly frees the space E defined between the two legs 31*a*, 31*b*. When each second elastic member 342 returns the corresponding selecting screw 34 from the moved away position to the returned position, the locking shaft 35 is returned automatically from the opening position to the locking position.

The actuator 38 is configured to take a pulled position and a pushed position. In pulled position, the actuator 38 makes it possible to position the selecting screw 34 in the moved away position and the locking shaft 35 in the opening position so as to position the locking system 3 in cocked configuration. When each second elastic member 342 returns the corresponding selecting screw 34 from the moved away position to the returned position, the actuator 38 is returned automatically from the pulled position to the pushed position. In pushed position, the actuator 38 bears against the front leg 31*a* here.

Figure 5A:
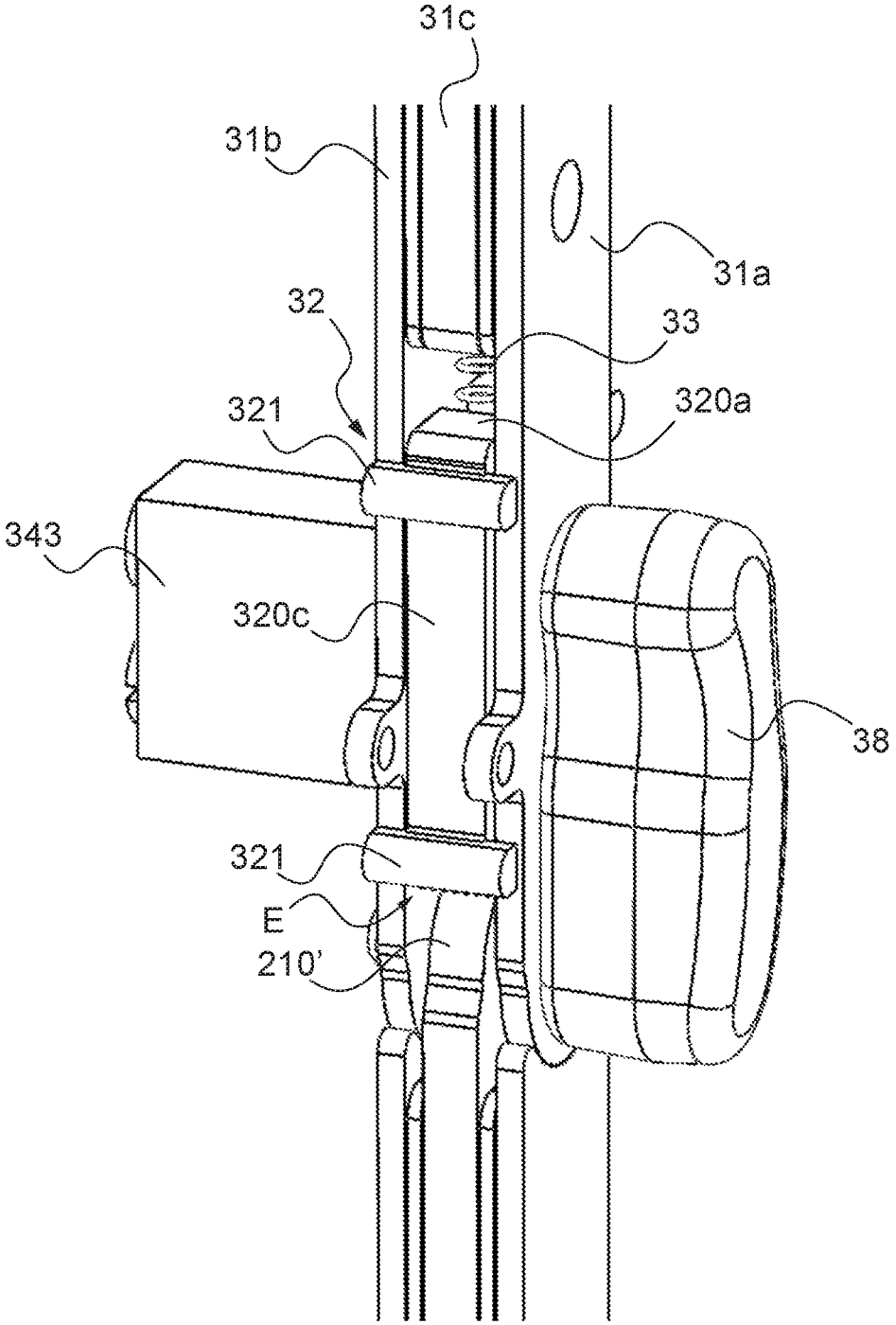
FIGS. 5*a* and 5*b* represent, respectively in full line and with transparency, the locking system of the connection device in which the eyelet of the second cabinet is locked.
Figure 5B:
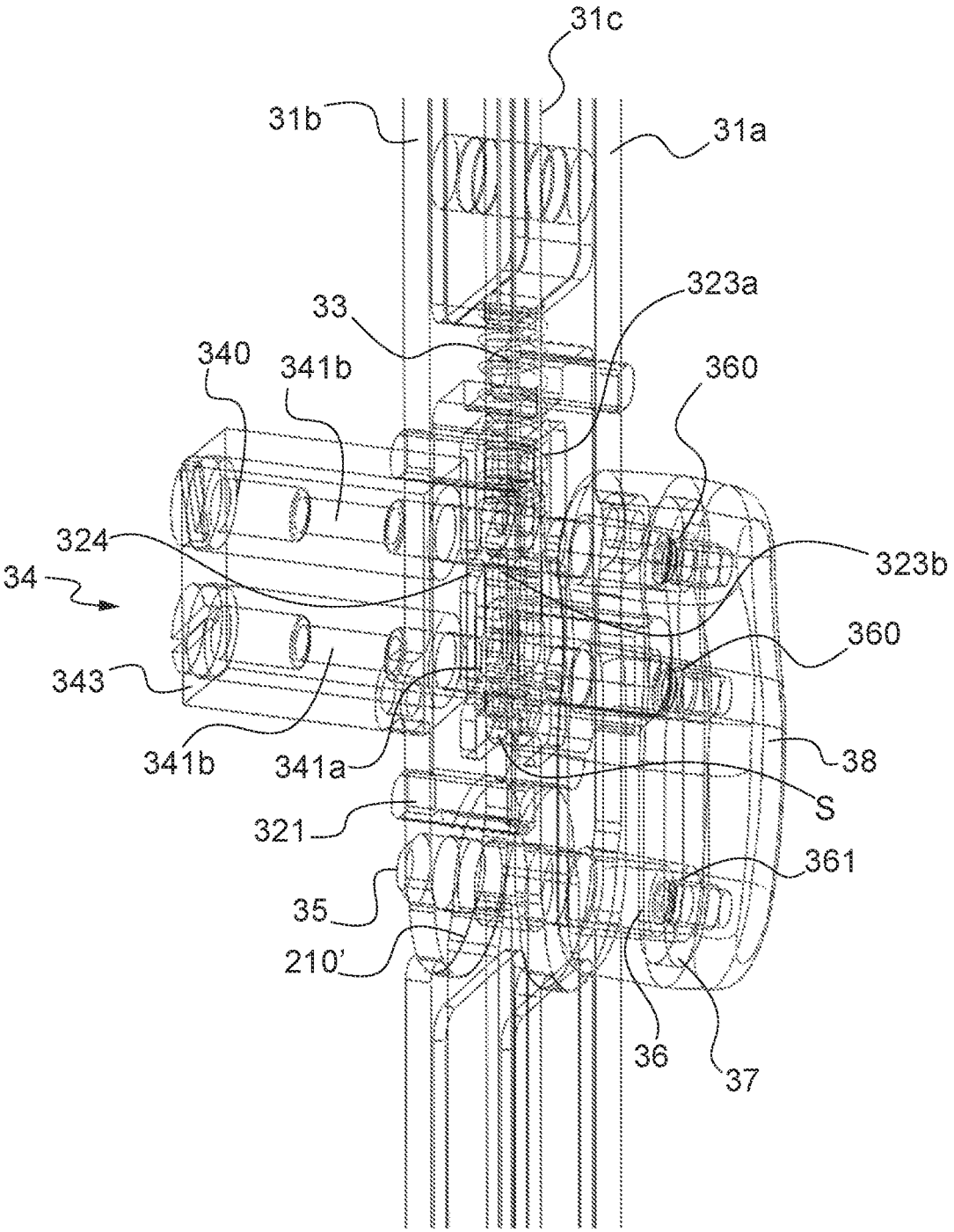
Figure 6:
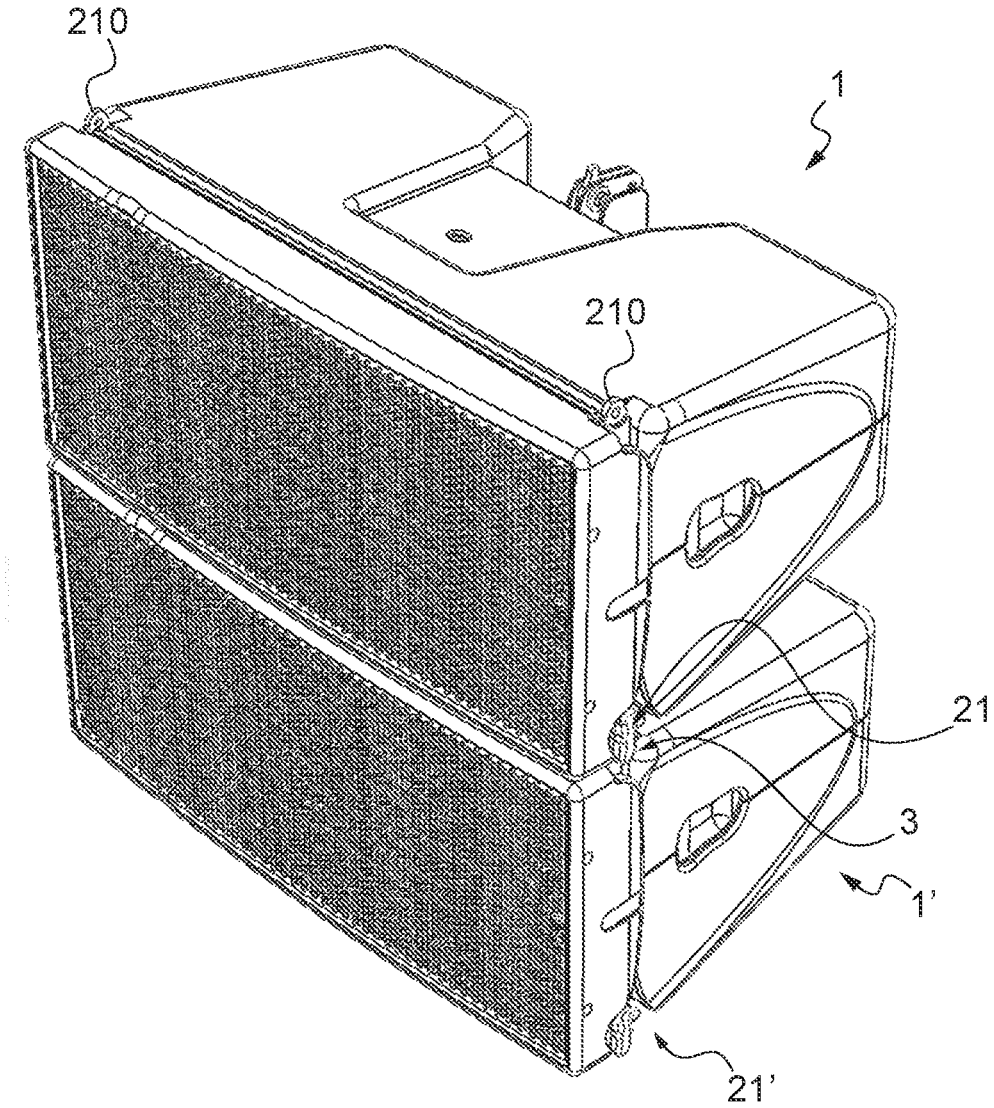
FIG. 6 is a perspective view of a first cabinet and a second cabinet assembled together by means of their connection devices.

The cocking and the locking of a first cabinet 1 with a second cabinet 1' by the connection device 21 as described above is explained with respect to FIGS. 4*a*, 4*b*, 5*a*, 5*b*, 6. In particular, FIGS. 4*a*, 4*b* illustrate the locking system in cocked configuration. FIGS. 5*a*, 5*b* illustrate the locking system in locked configuration. FIG. 6 represents the first and second cabinets 1, 1' assembled together.

The second cabinet 1' is identical to the first cabinet 1 here. The corresponding parts therefore bear the same numerical references, above which is placed the sign "'" (prime).

However, to assemble two cabinets, it is necessary for at least the second cabinet to comprise one or more eyelets capable of being locked in the locking system of the first cabinet.

The operations of cocking, locking and unlocking are described for a single connection device 21 and thus a single connection system 3 and an eyelet 210 of the first cabinet 1 as well as for a single connection device 21' and a single locking system 3' and an eyelet 210' (not shown in FIG. 6) of the second cabinet 1'. Of course, this description remains valid for the two connection devices 21 of the first cabinet 1 and the two connection devices 21' of the second cabinet 1'.

The steps of cocking the first cabinet 1 are the following.

The locking shaft 35 and the selecting screw 34 are pulled by means of the actuator 38. The locking shaft 35 is brought to the opening position; the locking shaft 35 is removed at least from the lower aperture 311 of the back leg 31*b* of the cabinet 1 and from the aperture of the eyelet 210' of the other cabinet 1' if an eyelet was locked thereto. The locking shaft 35 at least partly frees the space E defined between the two legs 31*a*, 31*b*. The locking shaft 35 possibly remains pushed into the lower aperture 311 of the front leg 31*a* (it may also however be clear of it). As the selecting screws 34 have been pulled, the wide sections of the shafts 341 of the selecting screw 34 are removed from the opening 323 of the slide 32. The selecting screws 34 take the moved away position. The second elastic member 342 of each selecting screw 34 is compressed. The wide portions 323*a* of the opening 323 thus surround the narrow sections of the shafts 341 of the selecting screws. The first elastic member 33 relaxes and thus pushes away the slide which then slides downwards so as to take the low position. The slide 32 slides until at least one of the selecting screws 34 comes to bear against a lower surface S of the slide 32 formed in the opening 323 and forming a stop for at least one selecting screw 34. In particular, the narrow parts 341*b* of the selecting screws 34 have then come to be positioned in narrow portions 323*b* of the opening 323 of the slide 32. Furthermore, a wide part 341*a* of a selecting screw 34 has then come to bear against part of the rim 320*e*. The system is thus held in cocked configuration.

The locking system 3 of the first cabinet 1 is thus in cocked configuration. The first cabinet 1 is then ready to be assembled to the second cabinet 1'.

The steps of assembling the two cabinets 1, 1' are the following.

The second cabinet 1' is disposed below the first cabinet 1, which is placed in cocked configuration. In the illustrated embodiment, the upper wall 10' of the second cabinet 1' is disposed facing the lower wall 11 of the first cabinet 1.

The eyelet 210' of the second cabinet 1' is disposed between the legs 31*a*, 31*b* of the first cabinet 1 at the location of the space E. The eyelet 210' of the second cabinet 1' is brought to bear against the slide 32 of the first cabinet 1, in particular on the lower face 320*b* of the slide part 320. The slide 32 of the first cabinet 1 slides upward, while being pushed away by the eyelet 210'. The first elastic member 33 is then compressed and the slide 32 then takes the high position.

On passing into the high position of the slide, the two selecting screws 34 become located respectively in the two wide portions 323*a* of the opening 323. The second elastic member 342 of each selecting screw 34 then automatically returns the selecting screws 34 to the returned position. At the same time, under the effect of the second elastic members 342 which, by returning the selecting screws 34, drives the actuator 38, the locking shaft 35 is also returned to the locking position. In locking position, the locking shaft 35 passes through the lower apertures 311 of the legs 31*a*, 31*b* of the first cabinet 1 and the eyelet 210' of the second cabinet 1'. The locking system 3 of the first cabinet 1 is thus in locked configuration, that is to say that the eyelet 210' of the second cabinet 1' is engaged in the locking system 3 of the first cabinet 1. The locking shaft 35 ensures proper locking of the eyelet 210' of the second cabinet 1' in the locking system 3 of the first cabinet 1.

The unlocking of the two cabinets 1, 1' is carried out by uncocking the first cabinet 1. This makes it possible to remove the eyelet 210' from the second cabinet 1' from its locking position in the locking system 3 of the first cabinet 1.

On unlocking, in order to avoid the cabinets remaining coupled together, the first cabinet 1 may be positioned in the forced open configuration. The actuator 38 is placed in pulled position, then driving the selecting screws 34 into moved away position and the locking shaft 35 into opening position. The first cabinet 1 may then be brought into a forced open configuration. For this, the slide 32 is further pushed upward by means of the grip member 322. The slide 32 is pushed to the upper position, which position is located higher here than the high position, that is to say a position in which the slide is closer to the intermediate leg 31*c* and in which the first elastic member 33 is more compressed than in the high position. The selecting screws 34 thus come to be in the intermediate narrow portion 323*b* and the lower narrow portion 323*b* of the opening 323. The narrow portions 323*b* of the opening 323 surround the narrow section of the shaft 341 of each selecting screw 34 and the corresponding wide part 341*a* of the shaft 341 then bears against a part of the rim 320*e*. The locking system 3 is thus held in the forced open configuration.

The first cabinet 1 is thus ready to be assembled with another loudspeaker cabinet.

In order to enable an automatic assembly of the second cabinet 1' with the first cabinet 1, the first cabinet 1 must be cocked.

The forced open configuration of the locking system of the first cabinet 1 has been described on the basis of the locked configuration. Of course, the first cabinet 1 may be placed in forced open configuration after having been fully cocked.

Furthermore, in the described example, the cabinet may be placed in configuration by movement of the slide 32 to the upper configuration by means of the grip member 322. Of course, the movement of the slide may be achieved otherwise, in particular by means of a different grip member or by the direct gripping and moving of the slide part 320.

In this example, the steps already described of assembly and of unlocking are preferably carried out simultaneously for the two locking systems 3 of the first cabinet 1 and the two eyelets 210' of the second cabinet 1'. Similarly, the steps of cocking and placing in forced open configuration of the first cabinet 1 may be achieved simultaneously for the two locking systems 3.

Naturally, the present invention is not limited to the embodiment described above.

The invention claimed is:

1. A frame (2) for a loudspeaker cabinet (1) comprising a connection device (21) for connecting to another loudspeaker cabinet, said connection device (21) comprising a eyelet (210) and a locking system (3), said locking system (3) comprising:

two legs, which are a front leg (31*a*) and a back leg (31*b*), disposed parallel to each other and each comprising a lower aperture (311) and an upper aperture (312);

a slide (32) disposed between the two legs (31*a*; 31*b*) and configured to slide between a high position and a low position, the slide (32) comprising an opening (323) having at least one wide portion (323*a*) and at least one narrow portion (323*b*), and being provided with two guide members (321), each bearing on an edge (313) of at least one of the two legs (31*a*; 31*b*) on opposite sides of the leg;

at least one spacer (39) linking the two legs (31*a*; 31*b*) to each other;

a first elastic member (33) connected to said slide (32) and configured to bring the slide (32) automatically from the high position to the low position;

a selecting screw (34) comprising a shaft (341) having at least one wide section and at least one narrow section, the shaft (341) of the selecting screw (34) passing through the upper aperture (312) of each of the legs (31*a*; 31*b*) and the opening (323) of the slide (32), and being configured to move between a returned position in which the at least one wide section of the shaft (341) is inside the opening (323) of the slide (32) and a moved away position in which the at least one narrow section of the shaft (341) of the screw is inside the opening (323) of the slide (32);

a second elastic member (342) connected to the selecting screw (34) and configured to return the selecting screw (34) automatically from the moved away position to the returned position;

a locking member comprising a locking shaft (35) configured to take a locking position in which the locking shaft (35) passes through the lower aperture (311) of each of the two legs (31*a*; 31*b*) and an opening position in which the locking shaft (35) frees at least partly a space (E) defined between the two legs (31*a*; 31*b*);

an actuator (38) configured to take a pulled position and a pushed position and joined to the selecting screw (34) and to the locking shaft (35), said locking system (3) being configured to take a locked configuration wherein:

the slide (32) is in high position;

the selecting screw (34) is in returned position in which the wide section of the shaft (341) is inside the wide portion (323*a*) of the opening (323) of the slide (32); and the locking shaft (35) is in locking position;

and a cocked configuration in which:

the slide (32) is in low position;

the selecting screw (34) is in moved away position in which the narrow section of the shaft (341) is inside the opening (323) of the slide (32); and the locking shaft (35) is in opening position, the locking system (3) passing from the locked configuration to the cocked configuration by movement of the actuator (38) and from the cocked configuration to the locked configuration by movement of the slide (32) from the low position to the high position.

2. The frame (2) for a loudspeaker cabinet according to claim 1, wherein, the locking member comprises a collar (37) joined to the locking shaft (35), the collar (37) being formed around the locking shaft (35) and having an outside diameter greater than a diameter of the lower aperture (311) of the front leg (31*a*).

3. The frame (2) for a loudspeaker cabinet according to claim 2, wherein, the locking system (3) comprises a connecting leg (36) fastened both to the locking member and to the selecting screw (34), and the locking member is crimped onto the connecting leg.

4. The frame (2) for a loudspeaker cabinet according to claim 2, wherein, the actuator (38) comprises a part that is molded over at least part of the locking member.

5. The frame (2) for a loudspeaker cabinet according to claim 2, wherein, the locking system (3) comprises two spacers (39) connecting the two legs (31*a*; 31*b*) to each other, the two spacers (39) being disposed on opposite sides of the legs (31*a*; 31*b*).

6. The frame (2) for a loudspeaker cabinet according to claim 2, wherein, the legs (31*a*; 31*b*) each comprise two upper apertures (312), the locking system (3) comprising two selecting screws (34), the shafts (341) of the two selecting screws (34) passing through the upper apertures (312) of the two legs (31*a*; 31*b*); the opening (323) of the slide (32) comprises at least two wide portions (323*a*) and at least two narrow portions (323*b*); the wide sections of the two selecting screws (34) being inside the opening (323) of the slide (32) in returned position and the narrow sections of the two selecting screws (34) being inside the opening(323) of the slide (32) in moved away position.

7. The frame (2) for a loudspeaker cabinet according to claim 1, wherein, the locking system (3) comprises a connecting leg (36) fastened both to the locking member and to the selecting screw (34), and the locking member is crimped onto the connecting leg.

8. The frame (2) for a loudspeaker cabinet according to claim 7, wherein, the actuator (38) comprises a part that is molded over at least part of the locking member.

9. The frame (2) for a loudspeaker cabinet according to claim 7, wherein, the locking system (3) comprises two spacers (39) connecting the two legs (31*a*; 31*b*) to each other, the two spacers (39) being disposed on opposite sides of the legs (31*a*; 31*b*).

10. The frame (2) for a loudspeaker cabinet according to claim 7, wherein, the legs (31*a*; 31*b*) each comprise two upper apertures (312), the locking system (3) comprising two selecting screws (34), the shafts (341) of the two selecting screws (34) passing through the upper apertures (312) of the two legs (31*a*; 31*b*); the opening (323) of the slide (32) comprises at least two wide portions (323*a*) and at least two narrow portions (323*b*); the wide sections of the two selecting screws (34) being inside the opening (323) of the slide (32) in returned position and the narrow sections of the two selecting screws (34) being inside the opening(323) of the slide (32) in moved away position.

11. The frame (2) for a loudspeaker cabinet according to claim 1, wherein, the actuator (38) comprises a part that is molded over at least part of the locking member.

12. The frame (2) for a loudspeaker cabinet according to claim 11, wherein, the locking system (3) comprises two spacers (39) connecting the two legs (31*a*; 31*b*) to each other, the two spacers (39) being disposed on opposite sides of the legs (31*a*; 31*b*).

13. The frame (2) for a loudspeaker cabinet according to claim 11, wherein, the legs (31*a*; 31*b*) each comprise two upper apertures (312), the locking system (3) comprising two selecting screws (34), the shafts (341) of the two selecting screws (34) passing through the upper apertures (312) of the two legs (31*a*; 31*b*); the opening (323) of the slide (32) comprises at least two wide portions (323*a*) and at least two narrow portions (323*b*); the wide sections of the two selecting screws (34) being inside the opening (323) of the slide (32) in returned position and the narrow sections of the two selecting screws (34) being inside the opening(323) of the slide (32) in moved away position.

14. The frame (2) for a loudspeaker cabinet according to claim 1, wherein, the locking system (3) comprises two spacers (39) connecting the two legs (31*a*; 31*b*) to each other, the two spacers (39) being disposed on opposite sides of the legs (31*a*; 31*b*).

15. The frame (2) for a loudspeaker cabinet according to claim 14, wherein, the legs (31*a*; 31*b*) each comprise two upper apertures (312), the locking system (3) comprising two selecting screws (34), the shafts (341) of the two selecting screws (34) passing through the upper apertures (312) of the two legs (31*a*; 31*b*); the opening (323) of the slide (32) comprises at least two wide portions (323*a*) and at least two narrow portions (323*b*); the wide sections of the two selecting screws (34) being inside the opening (323) of the slide (32) in returned position and the narrow sections of the two selecting screws (34) being inside the opening(323) of the slide (32) in moved away position.

16. The frame (2) for a loudspeaker cabinet according to claim 1, wherein, the legs (31*a*; 31*b*) each comprise two upper apertures (312), the locking system (3) comprising two selecting screws (34), the shafts (341) of the two selecting screws (34) passing through the upper apertures (312) of the two legs (31*a*; 31*b*); the opening (323) of the slide (32) comprises at least two wide portions (323*a*) and at least two narrow portions (323*b*); the wide sections of the two selecting screws (34) being inside the opening (323) of the slide (32) in returned position and the narrow sections of the two selecting screws (34) being inside the opening(323) of the slide (32) in moved away position.

17. The frame (2) for a loudspeaker cabinet according to claim 1, wherein, the slide (32) is provided with two pairs of guide members (321), each pair of guide members (321) bearing on an edge (313) of at least one of the two legs (31*a*; 31*b*) on opposite sides of the leg.

18. The frame (2) for a loudspeaker cabinet according to claim 1, wherein, the locking system (3) is configured to take a forced open configuration wherein:

the slide (32) is in an upper position;

the selecting screw (34) is in moved away position in which the narrow section of the shaft (341) is inside the opening (323) of the slide (32); and the locking shaft (35) is in opening position, the locking system (3) passing to the forced open configuration by movement of the slide (32) to the upper position.

19. A loudspeaker cabinet comprising a frame (2) according to claim 1.

20. A set of at least two loudspeaker cabinets comprising a first loudspeaker cabinet (1) according to claim 19 and a second loudspeaker cabinet (1') according to claim 19, wherein an eyelet (210') of the second cabinet (1') is locked in the locking system (3) of the first cabinet (1) when the first and second cabinets (1; 1') are assembled to each other.

* * * * *